US005237371A

United States Patent [19]

Hori

[11] Patent Number: 5,237,371

[45] Date of Patent: Aug. 17, 1993

[54] DEVELOPING APPARATUS HAVING CHARGER FOR CONTROLLING CHARGE ON DEVELOPER

[75] Inventor: Yasuro Hori, Katsuta, Japan

[73] Assignee: Hitachi, Ltd., Tokyo, Japan

[21] Appl. No.: 764,122

[22] Filed: Sep. 24, 1991

Related U.S. Application Data

[63] Continuation of Ser. No. 407,578, Sep. 15, 1989, abandoned.

[30] Foreign Application Priority Data

Sep. 20, 1988 [JP] Japan ..... 63-233428

[51] Int. Cl.[5] ..... G03G 15/16

[52] U.S. Cl. ..... 355/246; 355/208; 355/209; 430/120

[58] Field of Search ..... 355/208, 245, 246, 251, 355/253, 206, 209; 430/120; 118/653, 656, 657, 658

[56] References Cited

U.S. PATENT DOCUMENTS

| | | | |
|---|---|---|---|
| 4,026,643 | 5/1977 | Bergman | 355/246 |
| 4,121,931 | 10/1978 | Nelson | 430/120 |
| 4,153,541 | 5/1979 | Rumpf et al. | 209/143 |
| 4,343,548 | 8/1982 | Bares et al. | 355/246 |
| 4,371,257 | 2/1983 | Nishikawa | 355/208 X |
| 4,422,749 | 12/1983 | Hoshino et al. | 355/261 X |
| 4,450,220 | 5/1984 | Haneda et al. | 355/245 X |
| 4,538,897 | 9/1985 | Osaka et al. | 355/246 |
| 4,618,241 | 10/1986 | Hays et al. | 430/120 X |
| 4,814,834 | 3/1989 | Endo et al. | 355/246 X |

FOREIGN PATENT DOCUMENTS

| | | |
|---|---|---|
| 53-31136 | 3/1978 | Japan . |
| 0070468 | 6/1981 | Japan . |
| 0101856 | 6/1982 | Japan . |
| 0167050 | 10/1982 | Japan . |
| 0061064 | 3/1986 | Japan . |
| 0099872 | 5/1986 | Japan . |
| 0287275 | 12/1987 | Japan . |
| 0135873 | 6/1988 | Japan . |
| 0187163 | 8/1988 | Japan . |

OTHER PUBLICATIONS

R. M. Schaffert, "Electrophotography", The Focal Press Theory On Development Of Zerography Image, Kyoritu Publishing, Section 5, pp. 329-347.

*Primary Examiner*—A. T. Grimley
*Assistant Examiner*—Robert Beatty
*Attorney, Agent, or Firm*—Kenyon & Kenyon

[57] ABSTRACT

An electrophotographic printing apparatus includes a developing device which uses developer including toner and carrier particles. The quantity of electrical charges on the developer is measured and the developer is charged to a constant charge level in accordance with the result of the measurement. Accordingly, the developing density can be stabilized and the service life of the developer can be lengthened and predicted. A computer provides automatic processing to control the quantity of electric charges on the developer.

12 Claims, 6 Drawing Sheets

(a)

FIG. 7 (a)
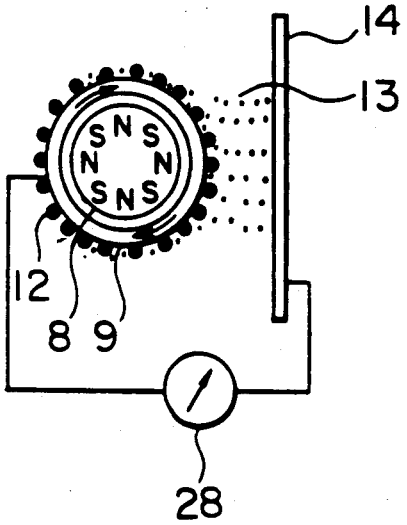
FIG. 7 (b)
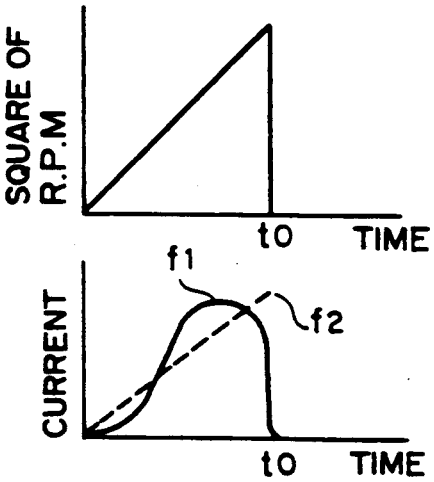
FIG. 7 (c)
FIG. 8 (a)
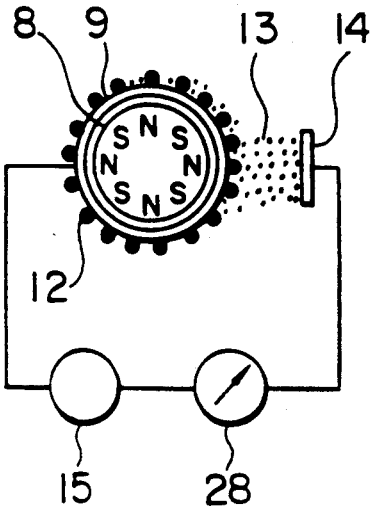
FIG. 8 (b)
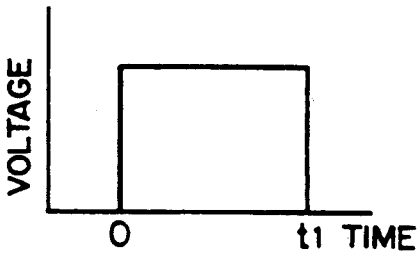
FIG. 8 (c)
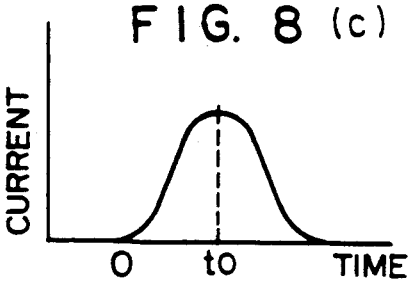

DEVELOPING APPARATUS HAVING CHARGER FOR CONTROLLING CHARGE ON DEVELOPER

This application is a continuation of application Ser. No. 07/407,578, filed on Sep. 15, 1989 now abandoned.

BACKGROUND OF THE INVENTION

The present invention relates to an electrophotographic printing apparatus, such as a laser beam printer or copying machine and methods of controlling the same. More particularly the present invention relates to a high-speed, high-density, long-service-life electrophotographic printing apparatus and methods of controlling the same.

Electric charging due to friction, corona static induction or by a corona charger is used in a conventional apparatus, as disclosed in Japanese Patent Publication JP-A-53-31136. A theoretical analysis of charging of a developer used in electrophotographic printing techniques is described in detail in R. M. Schaffert, "ELECTROPHOTOGRAPHY", published by THE FOCAL PRESS; and translated by Eiichi Inoue under the title "THEORY ON DEVELOPMENT OF XEROGRAPHY IMAGE" and published by Kyoritu Publishing, Section 5, pp. 329-347.

FIG. 9 shows printing by an electrophotographic apparatus used generally. The apparatus includes a charger 35, an exposure unit 40, a developing unit 65, a transfer unit 70, a fixing unit 80 and a cleaning unit 90. The developing unit 65 includes a carrier 12, toner 13, a toner density sensor 55. Toner 13 stored in a hopper 10 is supplied to the developing unit 65. The transfer unit 70 and the fixing unit 80 are disposed in the path 75 for recording paper. The mixed ratio of toner to carrier is measured by the toner density, sensor 55. The operation of supplying toner controls the toner density to be constant.

In the electrophotographic processing, part of the charged developer is lost in transference to the recording paper, the electric charges on most of the developer are cyclicly moved in the developing unit 6 and repeatedly used. By such cyclic motion, the developer cannot maintain its initial quantity of electric charges and the quantity of charges decreases. This is a so-called fatigue or deterioration of the developer. In these well-known examples, a decrease in the quantity of charges is predicted and a slightly excessive constant quantity of charges is supplied. In these known examples, an electrophotographic process is not found in which the developer in actual use is taken, its quantity of electric charges is measured, and the developer is recharged in accordance with the result of the measurement to control the quantity of electric charges.

In the prior art, a quantity of electric charges changes depending on the frequency of use of the developer and the ambient conditions under which the developer is used, and measures for keeping the quantity of charges constant are not provided. Other problems with the prior art are a change in the developer density, toner scattering and hence the shortening of the service life of the developer.

SUMMARY OF THE INVENTION

The present invention solves the above problems of the prior art by keeping a quantity of electric charges borne on a developer at constant value, to stabilize the developer density, and by increasing and predicting the service life of the developer.

The solution involves measuring a quantity of electric charges on toner and a carrier constituting the developer, actuating a charging mechanism in accordance with the result of the measurement, and controlling the quantity of charges on the toner and carrier at a constant value.

In the electrophotographic printing apparatus according to the present invention, toner and carrier are put in a space for movement using centrifugal force, in a magnetic field and in an electric field. A quantity of charges on the toner and carrier is measured using the respective forces applied to the toner carrier or the difference between the forces. The quantity of charges is then controlled by frictional or corona charging so as to be within a prescribed value which will be described later in more detail. A two-component developer is separated into toner and carrier using a centrifugal force or a static electric and the respective quantities of charges are measured. The toner and carrier are then similarly charged to prescribed quantities of charges and then mixed.

BRIEF DESCRIPTION OF THE DRAWINGS

FIG. 7(*a*) illustrates the structure of one embodiment which performs separation and measurement simultaneously, FIG. 7(*b*) illustrates a timing diagram and FIG. 7(*c*) illustrates a current timing diagram.

FIG. 8(*a*) illustrates the structure of another embodiment which simultaneously performs the separation and measurement described in FIG. 2, FIG. 8(*b*) illustrates a voltage timing diagram and FIG. 8(*c*) illustrates a current timing diagram.

DESCRIPTION OF THE PREFERRED EMBODIMENTS

Figure 1:
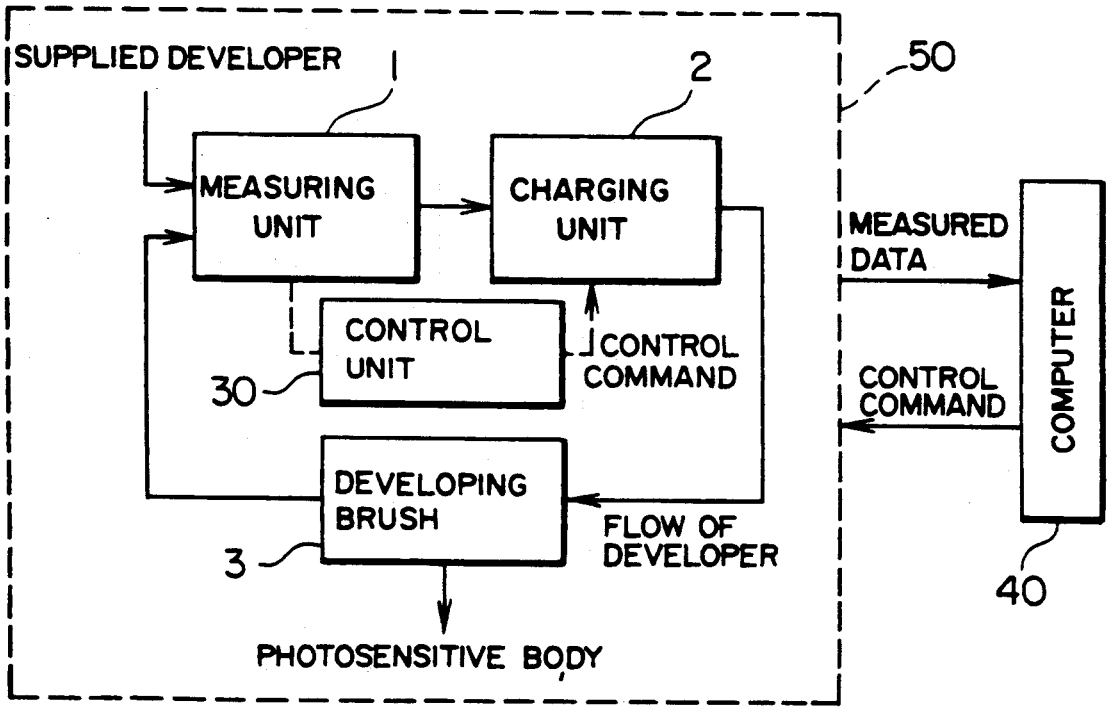
FIG. 1 is a block diagram of an embodiment of the present invention.
Figure 9:
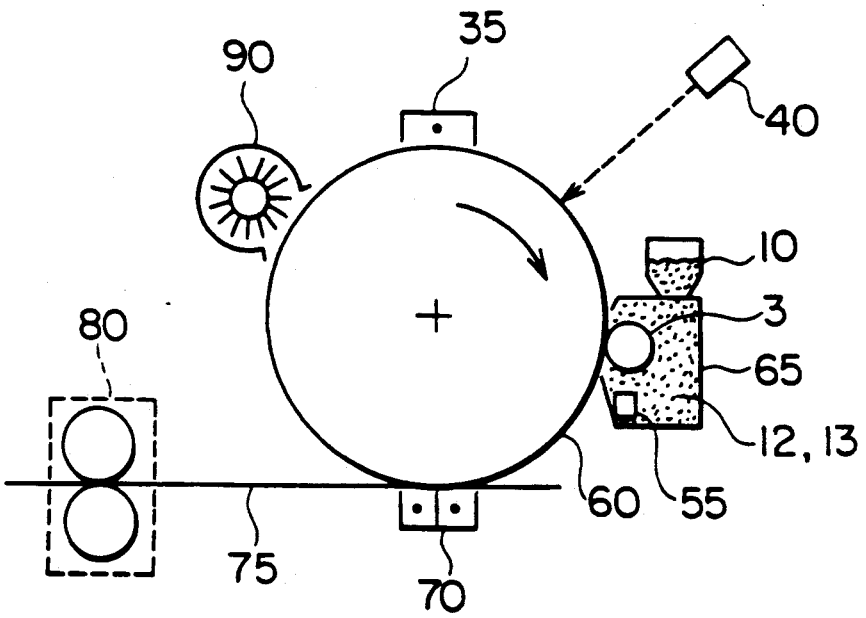
FIG. 9 (PRIOR ART)
FIG. 9 illustrates a printing process by an electrophotographic printing apparatus generally used.

FIG. 1 is a block diagram of one embodiment of the present invention and shows the flow of developer in an electrophotographic printing apparatus. In the present invention, a device can be added to the prior art systems such as that of FIG. 9. The device includes a measuring unit 1 for measuring a quantity of electric charge of the developer, a control unit 30 for outputting a control instruction based upon the quantity of the electric charge which should be applied to the developer on the basis of the result of the measurement, and a charging unit 2 for charging the developer on the basis of the control instruction, all provided in or near the developing unit 65 shown in FIG. 9.

With this construction, at first, the electric charge quantity of the developer which consists of a toner or toner and carrier is measured. Then the developer is charged to a predetermined value and the developer is carried to the developing brush 3. At the brush 3, the developer is used for developing. In the present invention, the electric charge quantity of the developer is maintained to the predetermined value for a long time in spite of the change of the electric charge quantity which is caused by the change of the amount supply and consumption and the change of the characteristic of the developer. As a result, desired recording density is usually obtained. Toner scattering and fog which have bad influences are also inhibited.

According to the particular embodiment, a change in the quantity of charges on the developer can be prevented which is due to the fatigue of the developer, a change in the toner density, and changes in the ambient temperature and humidity. Also a stabilized recording density is realized.

Figure 10:
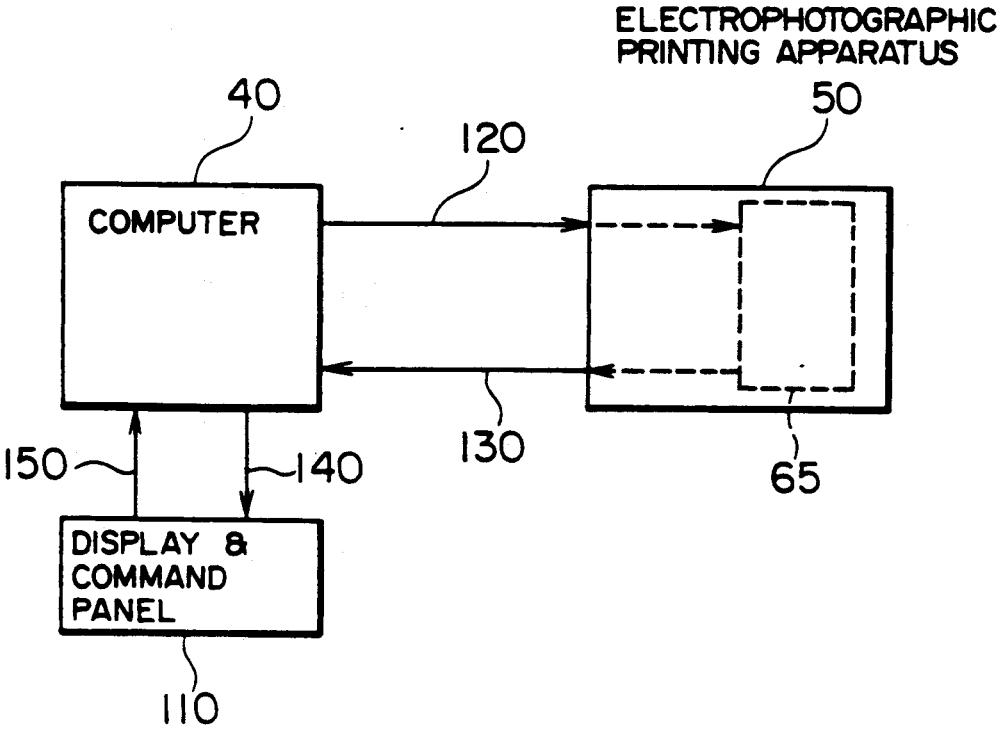
FIG. 10 illustrates the systematic structure of the electrophotographic printing apparatus as an embodiment of the present invention.

A plurality of recording densities are achieved by changing the quantity of charges on the developer in several steps. As shown in FIG. 10, the recording density may be changed by changing the quantity of charges in accordance with a command 120 from a controller or computer 40 which controls the electrophotographic printing apparatus. The command is received from a display and command panel 110 via a route 150 and display of output information 140, such as measured signal 130, are performed by the display and command panel 110.

In the course of repeated charging of the developer as mentioned above, control of the quantity of charges on the developer to the prescribed value might be lost in the absence of the present invention because the developer becomes fatigued, deteriorated and difficult to charge. When the quantity of charges on the developer decreases, the following measures should be taken:

(1) The speed of the stirrer is increased to increase the stirring energy; and (2) A quantity of charges injected into the developer by the charging unit should be increased;

However, the quantity of charges imparted has a limit both in the cases (1) and (2).

In the case (1), the phenomenon "spent" in which toner is fixed to the carrier in the developer is likely to occur even if the stirring energy may be increased thereby shortening the service life of the developer.

The service life of the developer can be determined by checking the history of charging of the developer since it was supplied as unused new developer and comparing the history with data on a pattern of fatigue or service life prepared beforehand. In comparison with the data on a pattern of fatigue or service life, it is determined that the service life of the developer is lost and part or the whole of the developer should be replaced. This determination and the display of the replacement may be performed by the electrophotographic printing apparatus 50 itself or by the controller or computer 40 to control the recording apparatus as shown in FIG. 1.

Figure 2:
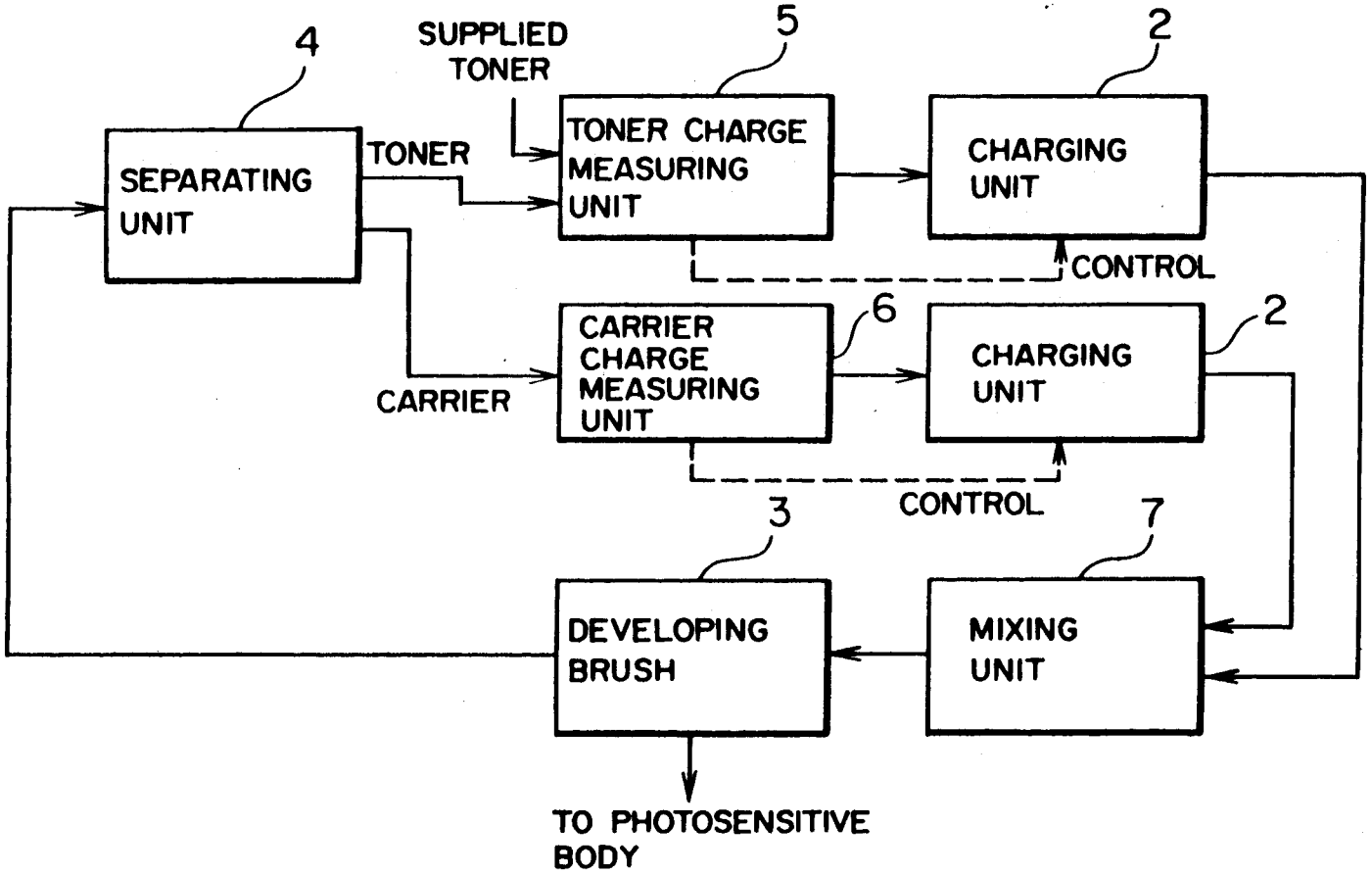
FIG. 2 is a block diagram of another embodiment of the present invention.

FIG. 2 illustrates another embodiment of the present invention which uses a developer containing two components, namely, carrier and toner, which have electric char of opposite polarities drawn to each other by a static electric drawing force. It is not easy to measure the quantity of electric charges on the toner and carrier sticking to each other because a small quantity of electric charges will be measured which is present in the developer which is substantially in a neutralized state. In order to cope with this, a separating unit 4 is provided at the initial stage of the processing unit in FIG. 2 to separate toner and carrier. The respective quantities of electric charges on the separated toner and carrier are measured by a toner charge measuring unit 5 and carrier charge measuring unit 6, respectively. The toner and carrier are charged by the respective charging units 2 and then mixed by a mixing unit 7 and the resulting developer is supplied to the developing brush 3. In this case, the quantity of electric charges on the whole of the toner and the quantity of charges on the whole of the carriers are required to be controlled so as to be equal in absolute value but opposite in polarity. By doing so, the developer consisting of two components can also produce an effect similar to that described with reference to FIG. 1.

Figure 3:
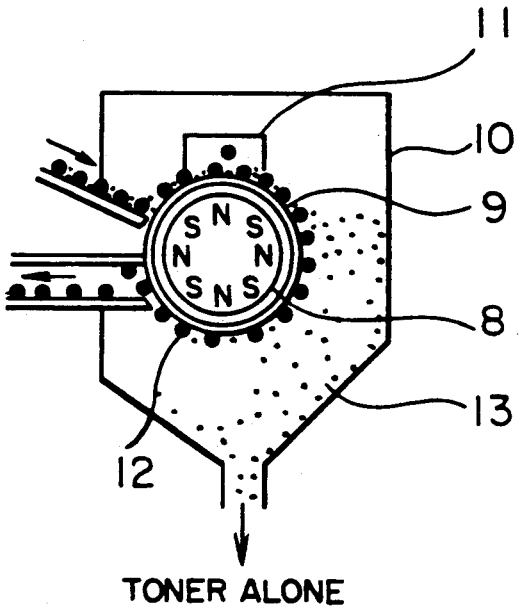
FIG. 3 illustrates the structure of one embodiment of a separating unit of FIG. 1.
Figure 4:
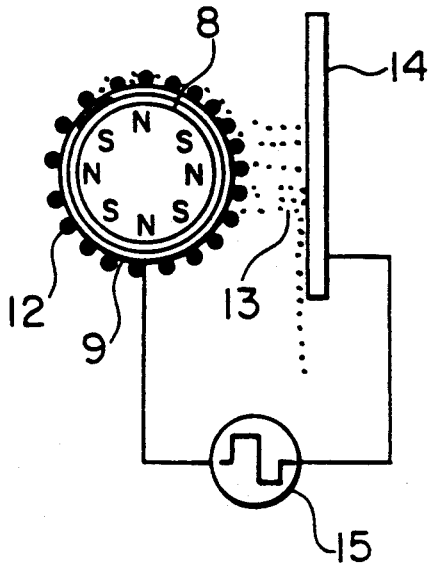
FIG. 4 illustrates the structure of another embodiment of the separating unit of FIG. 1.

FIGS. 3 and 4 show an embodiment of the separating unit 4 for the toner and carrier. In FIG. 3, a rotating non-magnetic sleeve 9 and an AC corona charging unit 11 are disposed outside a multi-polarity magnetic roll 8 accommodated in the hopper 10. Toner is separated from carrier by the use of the difference between the centrifugal forces exerted on the toner 13 and carrier 12 due to the difference between their masses by rotating the sleeve 9 at high speed. There is no problem in the separating operation even if there is no AC corona charging unit 11, but the use of the AC corona charging unit serves to neutralize the charges on the toner and carrier with positive and negative charges generated by the charging unit. Therefore, the drawing force exerted between the toner and carrier decreases to thereby facilitate the separation.

In FIG. 4, a rotating non-magnetic sleeve 9 is disposed outside a multi-polarity magnetic roll 8 and an electrode 14 is disposed spaced from the sleeve 9. The developer is drawn by a magnetic force onto the sleeve 9 because the toner as one component of the developer is made of a non-magnetic material while the carrier is made of a magnetic material. Thus, the toner is drawn onto the carrier by static electric force while the carrier is drawn onto the sleeve by magnetic force. Under such condition, a voltage source 15 applies a high electric field across the electrode 14 and sleeve 9 to thereby separate the carrier and toner from each other because the static electric force exerted by the toner on the carrier is opposed by a larger static electric due to the high electric field. When the toner bears positive charges, a negative voltage is applied to the electrode 14 while when the toner bears negative charges, a positive voltage is applied to the electrode 14. Thus, the toner 13 is deposited on the electrode 14. The condition to separate the toner is given by $$qE > \frac{q\,q_0}{4\pi\epsilon_0 d^2} \tag{1}$$

where q is the quantity of electric charges on the toner;

$q_0$ is the quantity of electric charges on the carrier;

d is the distance in electric charge between the toner and carrier;

$\epsilon_0$ is a dielectric constant; and

E is the electric field formed across the electrode 14 and sleeve 9.

The toner can be separated by being placed in the electric field E satisfying the equation (1). In this case, since the toner continues to stick to the electrode 14 so long as a voltage continues to be applied across the sleeve and the electrode 14, the voltage should be changed to zero volts with a plus sign or zero volts with opposite sign at appropriate time intervals to separate the sticking toner 13 from the electrode 14. After the toner is separated, the carrier can be carried away from the sleeve 9 using a conventional magnetic process (not illustrated).

Figure 5:
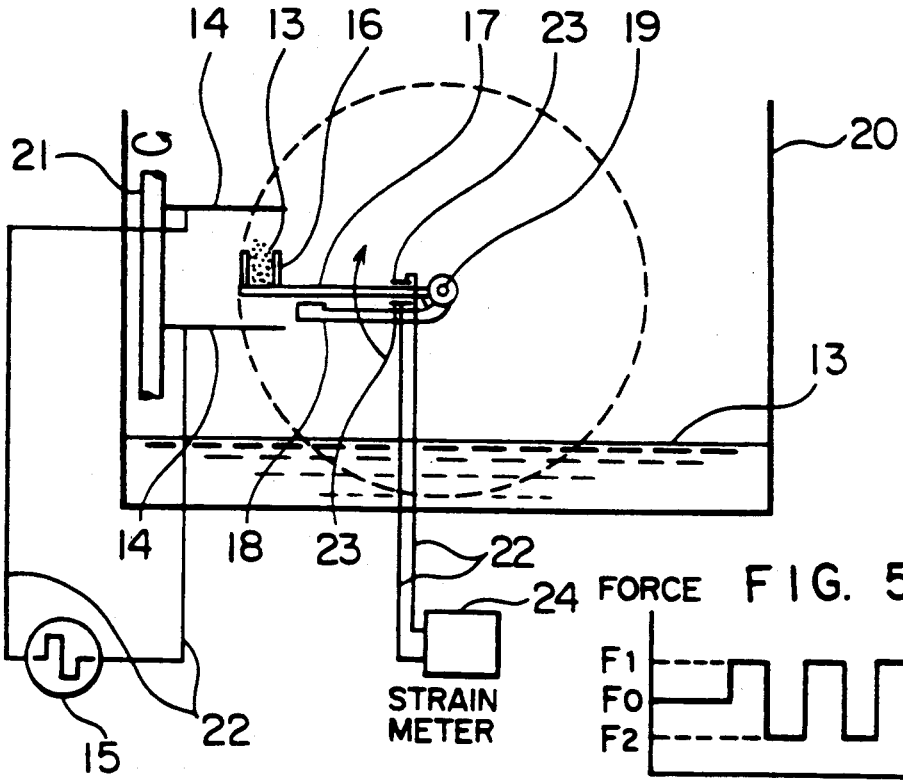
FIG. 5(*a*) the structure of one embodiment of a measuring unit of FIG. 2 and FIG. 5(*b*) illustrates a timing diagram of a force applied in FIG. 5(*a*).
Figure 5:
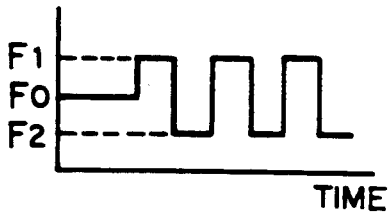
Figure 6:
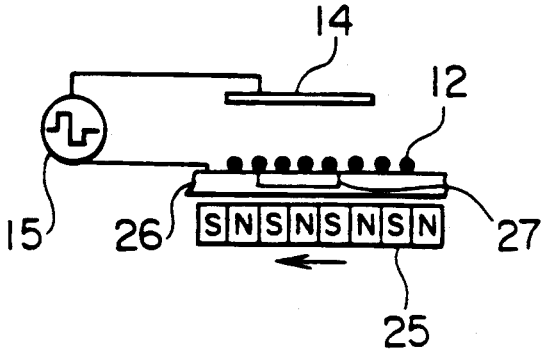
FIG. 6(*a*) illustrates the structure of another embodiment of the measuring unit of FIG. 2 and FIG. 6(*b*) illustrates a timing diagram of an applied force.
Figure 6:
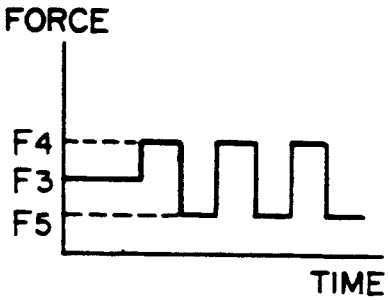

FIGS. 5(*a*) and 5(*b*) and FIGS. 6(*a*) and 6(*b*) illustrate different embodiments of the unit for measuring the quantity of electric charges on the developer shown in FIG. 2. FIG. 5(*a*) denotes the unit for measuring the quantity of charges on the toner. This unit includes a measuring arm 17 with a bucket 16 and rotatable around a shaft 19 and a rotatable reinforce arm 18. The arms 17 and 18 are rotated in the direction of the illustrated arrow to scoop up toner 13 in the hopper 20. When the arms are positioned at their horizontal position, the pair of electrodes 14 supported by an insulator rod 21 is rotated to hold the bucket 16 there between. Under such condition, a square wave voltage is applied from the voltage source 15 across the pair of electrodes 14. Thus, the gravity of the toner in the bucket 16 acts downward on the measuring arm 17. On the other hand, by the electric field across the pair of electrodes 14, a square force alternately acts vertically on the electric charges on the toner. These forces deform the measuring arm 17 vertically. A strain gauge 23 is attached to the base of the measuring arm 17 and connected via leads 22 to a strain meter 24 to indirectly measure the force applied to the bucket 16. The force applied changes like a square wave with time as shown in FIG. 5(b). The ratio of the gravity to the static electric force is given by $$\frac{\text{static force}}{\text{gravity}} = \frac{qE}{mg} = \frac{F_1 - F_2}{F_1 + F_2} = \frac{F_1 - F_2}{2F_0} \qquad (2)$$

where $F_0$ is the average value of the force applied, $F_1$ is the maximum value of the force applied, $F_2$ is the minimum value of the force applied, E is the electric field applied, q is a quantity of charges on the toner, g is the acceleration due to gravity and and m is the mass of the toner. Thus, the quantity of electric charges on the toner per unit weight q/m can be obtained. The measuring arm 17 is easily deformable in order to improve a sensitivity of measurement. The reinforced arm 18 is provided to support the measuring arm 17 when same exceeds a prescribed quantity of deformation so as to prevent a damage to the measuring arm 17 when the toner is scooped up. Although the weight of the toner is small, it does not influence the accuracy of the measurement. $F_1$ and $F_2$ are repeatedly measured many times and averaged to improve the accuracy of the measurement. The toner in the bucket 16 falls by gravity when it rotates through 180 degrees from the position shown in FIG. 5 and then new toner is also scooped up by the bucket 16 in the next rotation. In this way, a quantity of electric charges on new toner is measured.

FIGS. 6(*a*) and 6(*b*) illustrates the unit for measuring a quantity of charges on the carrier. Carrier 12 is carried onto a carrier plate 26 by a moving multi-polarity magnet 25. A piezoelectric element 27 is imbedded in a part of the carrier plate 26 to measure the vertical force produced by the carrier. A electrode 14 is disposed above the carrier plate 26 to apply a square wave voltage across the electrode 14 and carrier plate 26. By such structure, the force detected by the piezoelectric element 27 changes like a square wave with time as shown. Thus, the quantity of electric charge on the carrier is obtained by $$\frac{\text{static force}}{\text{magnetic force + gravity}} = \frac{qE}{Fm + Mg} = \frac{F_4 - F_5}{F_4 + F_5} = \frac{F_4 - F_5}{2F_3} \qquad (3)$$

where $F_3$ is the average value of the force applied;

$F_4$ is the maximum value of the force applied;

$F_5$ is the minimum value of the force applied;

q is the quantity of electric charge on the carrier;

Fm is the magnetic force exerted on the carrier; g is the acceleration due to gravity and M is the mass of the carrier.

Since Fm is proportional to the volume, and hence mass of the carrier, the quantity of electric charges per unit weight of the carrier g/M can be obtained from the equation (3).

FIGS. 7(*a*) through 7(*b*) and 8(*a*) through 8(*c*) each illustrate a device including the separating unit 4 for the toner and carrier and the toner electric charge quantity measuring unit 5, shown in FIG. 2. In FIG. 7(*a*), a rotating sleeve 9 is disposed outside a multi-polarity magnetic roll 8, and an electrode 14 is provided spaced from the sleeve 9. An ammeter 28 measures a current flowing through the electrode 14 and sleeve 9. In this arrangement, the rotational speed of the sleeve 9 increases from zero as shown. A centrifugal force is then exerted on the toner, and toner particles bearing small quantities of electric charges are earlier separated from the carrier to arrive at the electrode 14. Since the toner bears electric charges thereon, it is measured as a current by the ammeter 28. An example of the measured current is shown by $f_1$, as shown in FIG. 7(*c*). The average quantity of electric charges on the toner is calculated by the following equation:

$$f_2 = \alpha \cdot t$$

where $\alpha$ is constant, and t is time. In this case, it is assumed that electric charges are distributed uniformly on the toner.

Since, however, the actual electric charges on the toner are not distributed uniformly, a peak appears with time depending on distribution. An actually distributed electric charges $f_1$ are considered to be equal in total quantity to the average distributed electric charges $f_2$. Therefore, $$\Sigma f_1 = \Sigma f_2 = \frac{1}{2}\alpha t^2 \qquad (4)$$

Thus $$\alpha = \frac{2\Sigma f_1}{t_0^2}$$

By calculating the time $t_1$ when the difference between $f_1$ and $f_2$:

$$f_1 - \frac{2\Sigma f_1}{t_0^2} t$$

becomes maximum and calculating the centrifugal force at that time, the quantity of electric charges is obtained.

Namely, the centrifugal force f exerted on the toner is given by $$f = mr\left(\frac{2\pi n_1}{60}\right)^2 \quad \text{(i)}$$

where $n_1$ is the rotational speed of the sleeve 9 (rpm) at time $t_1$, m is the mass of the toner, and r is the rotational radius of the sleeve.

From the conditions where the centrifugal force is equal to the drawing force between the toner and carrier, the quantity of electric charges on the toner is calculated by $$mr\left(\frac{2\pi n_1}{60}\right)^2 = \frac{q \cdot q_0}{4\pi\epsilon_0 d^2} \quad \text{(ii)}$$

The quantities of electric charges $q_0$ and q on the carrier and on the toner are unknown, but the ratio in weight of toner to carrier is known, and the respective total quantities of electric charges on the toner and on the carrier are equal and opposite in sign. Since the ratio in weight of carrier to toner, indicated by $\beta$, is known, the following equation holds:

$$St \cdot m = \beta \cdot Sc \cdot M \quad \text{(iii)}$$

where St is the whole number of toner particles and Sc is the whole number of carriers. Therefore, the number of toner particles contained in one carrier particle is given by $$\gamma = \frac{St}{Sc} = \frac{\beta \cdot M}{m} \quad \text{(iv)}$$

The relationship between q and $q_0$ is calculated using this $\gamma$. Since the quantities of electric charges on the toner and carrier are equal, $$\gamma \cdot q = q_0 \quad \text{(v)}$$

Substituting the equations (iv), (v) into the equation (ii) ,and rearranging the resulting equation with reference to q, the following equation is obtained.

$$\frac{q}{m} = \frac{2\pi n_1 d}{60} \cdot \sqrt{\frac{4\pi\epsilon_0\gamma}{\beta \cdot M}} \quad \text{(vi)}$$

FIGS. 8(*a*) through 8(*c*) illustrate an arrangement in which toner particles are separated and flown by applying an electric field to the toner particles and the quantity of electric charges on the toner is calculated from the flying time, but differ from FIGS. 7(*a*) through 7(*c*). In FIG. 8, a step-like electric field higher enough to separate toner from carrier is applied to the electrode 14 using a voltage source 15. If a current flowing through the electrode 14 and sleeve 9 is measured using an ammeter 28, a mountain-like current wave form with time is obtained.

While the condition in which the toner separated from the carrier is shown in the equation (1). the d in the equation (1) rapidly increases as the carrier particles are separated from the toner and the drawing force by the carrier decreases. On the other hand, the movement of the toner is given by $$m\frac{d^2x}{dt^2} + c\frac{dx}{dt} = qE - \frac{q \cdot q_0}{4\pi\epsilon_0 x^2} \quad (5)$$

where x is the displacement of the toner; and c is air resistance to the toner.

Since the movement of the toner is substantially determined by $$m = \frac{d^2x}{dt^2}$$

and qE, the time required for the toner to arrive at the electrode is given by $$t = \frac{2mx_0}{qE} \quad (6)$$

where $x_0$ is the distance between the electrode 14 and sleeve 9. As shown, by calculating a time $t_0$ when the current becomes maximum and substituting it to the equation (6), a quantity of electric charges per unit toner mass q/m is calculated. Namely, setting $t = t_0$, $$t_0^2 = \frac{2 \cdot m \cdot x_0}{q \cdot E}$$

Then $$\frac{q}{m} = \frac{2 \cdot x_0}{t_0^2 \cdot E}$$

As described above, in the embodiments of FIGS. 7(*a*) through 7(*c*) and 8(*a*) through 8(*c*) separation and measurement can be performed simultaneously by using only a part of the developer.

By using the processes illustrated in FIGS. 3 to 6, a method and apparatus is provided which calculates the charging capacity of the toner and carrier, eliminates components of low charging capacity, and selects a developer having a predetermined charging capacity. Thus, a developer of a stabilized density and of fewer flying particles is provided.

The present invention is applicable to any electrophotographic printing apparatus which uses toner to visualize or develop a static latent image using electric charges by the toner; for example, copying machines, laser beam printers, light emitting diode printers, liquid crystal printers, and electrostatic printers. Control is possible over a printing process to obtain a printed image by automatically measuring a quantity of electric charges on the developer, a bias voltage applied to the developer in the developing unit, a developing gap between the developing roll of the developing unit and the photosensitive body, toner density, etc., using sensors in accordance with a printed image as the final result of recording and feeding back these measured data for control of the quantity of electric charges on the developer.

According to the present invention, a quantity of electric charges on the developer is measured and controlled to a prescribed value in accordance with the result of the measurement to thereby provide stabilized records of up to high density. The flying of toner is prevented. Even if the charging capacity of the developer may be decreased, the quantity of charges borne on the developer can be recovered and maintained to and at the prescribed value to thereby extend the service life of the developer. If the quantity of electric charges on the developer does not arrive at the prescribed value even if it may be controlled, this information can be given as a measurement command to the controller or computer to thereby control the state of the developer in the electrophotographic printing apparatus on behalf of the operator. It is possible to supply these measurement signals, to the computer and cause the same to judge them automatically as to control the state of the developer without troubling the operator. Therefore, a request for replacement of the developer and an undesirable time of replacement of the developer based on the result of determination about the service life of the developer can be displayed externally or reported.

What is claimed is:

1. An electrophotographic printing apparatus comprising:
- means for electrically charging a developer comprising non-magnetic toner and carrier which draws the toner thereto by static electric force and carries the toner;
- means for measuring a quantity of electric charges on the developer, comprising:
  - means for measuring the quantity of the electric charges on the toner and on the carrier separated during a developing operation;
- means for controlling the quantity of electric charges on the developer in accordance with the result of the measurement comprising:
  - means for charging the toner and carrier to predetermined values; and
- means for separating the toner and carrier in the developer from each other before measuring a quantity of the electric charges thereof.

2. An electrophotographic printing apparatus according to claim 1, wherein the carrier includes a magnetic material, and said means for separating comprises:
- means for attracting the carrier by magnetic force; and
- means for attracting the toner by static electric force.

3. An electrophotographic printing apparatus according to claim 1, wherein said means for measuring comprises:
- means for generating magnetic force for holding the developer around an outer periphery of a sleeve;
- means for applying centrifugal force to said developer comprising non-magnetic toner to separate said developer;
- an electrode receiving said toner from said separated developer;
- means for measuring a current flowing through said electrode; and
- means for calculating said quantity of electric charges of said toner on the basis of said measured current.

4. An electrophotographic printing apparatus according to claim 1, wherein said means for measuring comprises:
- means for generating magnetic force for holding said carrier around an outer periphery of a sleeve;
- means for generating static electric force outside of said sleeve;
- an electrode receiving said non-magnetic toner which is attracted by said static electric force;
- means for measuring a current flowing in said electrode; and
- means for calculating said quantity of electric charges on the basis of said measured current.

5. An electrophotographic printing apparatus comprising:
- means for electrically charging a developer, said developer includes toner and carrier which draws the toner thereto by static electric force and carries the toner;
- means for measuring a quantity of electric charges on the developer;
- means for controlling the quantity of electric charges on the developer in accordance with the result of the measurement; and
- means for separating the toner and the carrier in the developer from each other, including:
  - means for applying centrifugal force to the toner and carrier; and
  - means for neutralizing the quantity of the electric charges of the toner and carrier.

6. An electrophotographic printing apparatus according to claim 5, wherein said means for separating comprises:
- a rotary sleeve having magnets at an inner surface thereof in order to hold said developer on an outer surface of said rotary sleeve; and
- means for scattering said toner by a centrifugal force generated by a rotation of said rotary sleeve toward an electrode disposed outside of said rotary sleeve, said carrier being attracted to said rotary sleeve by a magnetic force;
- wherein said means for measuring comprises means for detecting said quantity of the electric charge of said toner from a current flowing through said electrode.

7. An electrophotographic printing apparatus comprising:
- means for electrically charging a developer, said developer includes toner and carrier which draws the toner thereto by static electric force and carries the toner;
- means for measuring a quantity of electric charges on the developer including a:
  - means for measuring forces applied to a container in which part of said toner is accommodated;
  - means for applying static electric force to said accommodated toner; and
  - means for calculating said quantity of the electric charges of said toner on the basis of said measured forces; and
- means for controlling the quantity of electric charges on the developer in accordance with the result of the measurement.

8. An electrophotographic printing apparatus comprising:
- means for electrically charging a developer, said developer includes toner and carrier which draws the toner thereto by static electric force and carries the toner;

means for measuring a quantity of electric charges of the developer including:

means for applying magnetic force to said carrier;

means for applying static electric force to said carrier; and means for calculating said quantity of electric charges of said carrier on the basis of said applied forces;

means for controlling the quantity of electric charges on the developer in accordance with the result of the measurement; and means for separating the toner and the carrier in the developer from each other.

9. A method of controlling an electrophotographic printing apparatus, comprising the steps of:

separating a developer into a non-magnetic toner and a carrier for carrying the non-magnetic toner;

measuring respective quantities of electric charges on the toner and carrier;

charging the toner and carrier so as to carry corresponding predetermined quantities of electric charges; and remixing the toner and carrier.

10. An electrophotographic printing apparatus comprising:

means for separating a carrier and a toner from each other in a developer including said carrier and said toner;

means for measuring quantities of electric charges of said separated carrier and toner;

means for charging said carrier and toner, respectively; and means for controlling the quantity of the electric charges by respectively charging said carrier and said toner to predetermined values on the basis of said measured quantities of said electric charges.

11. An electrophotographic printing apparatus according to claim 3, further comprising:

means for successively recording and judging said measured quantities of the electric charges and conditions of said charging; and means for automatically judging service life of said developer in response to said means for successively recording and judging.

12. An electrophotographic printing apparatus according to claim 4, further comprising means for displaying data concerning said judged service life and a time for replacement of said developer which corresponds to said judged service life.

* * * * *

UNITED STATES PATENT AND TRADEMARK OFFICE

CERTIFICATE OF CORRECTION

PATENT NO. : 5,237,371

DATED : 17 August 1993

INVENTOR(S) : Yasuro HORI

It is certified that error appears in the above-indentified patent and that said Letters Patent is hereby corrected as shown below:

| Column | Line | |
|---|---|---|
| 1 | 43 | After "unit" change "6" to --65--. |
| 1 | 68 | Delete "borne". |
| 2 | 20 | After "electric" insert --force--. |
| 2 | 35 | After "5a" insert --illustrates--. |
| 3 | 12 | After "amount" insert --of--. |
| 3 | 66 | Change "char" to --charges--. |
| 4 | 49 | After "electric" insert --force--. |
| 9 | 19 | After "signals" delete ",". |
| 9 | 20 | After "automatically" insert --so--. |
| 9 | 42 | After "measurement" insert --,--. |
| 12 | 15 | Change "claim 3" to --claim 10--. |
| 12 | 23 | Change "claim 4" to --claim --11--. |

Signed and Sealed this

Twenty-ninth Day of March, 1994

*Attest:*

Bruce Lehman

BRUCE LEHMAN

*Attesting Officer*

*Commissioner of Patents and Trademarks*